US005586522A

United States Patent [19]

Phillis et al.

[11] Patent Number: 5,586,522

[45] Date of Patent: Dec. 24, 1996

[54] CYLINDER HEAD FOR INTERNAL COMBUSTION ENGINES

[76] Inventors: Lawrence R. Phillis, Box 220514, Newhall, Calif. 91322; Eugene W. VanDenBerg, II, 28169 Florence La., Canyon Country, Calif. 91351

[21] Appl. No.: 527,157

[22] Filed: Sep. 12, 1995

[51] Int. Cl.[6] ..... F02B 75/08

[52] U.S. Cl. ..... 123/41.82 R; 123/193.5

[58] Field of Search ..... 123/41.82 R, 41.82 A, 123/193.5, 669

[56] References Cited

U.S. PATENT DOCUMENTS

| | | | |
|---|---|---|---|
| 4,121,550 | 10/1978 | Wand et al. | 123/41.31 |
| 4,508,066 | 4/1985 | Hartsock | 123/41.82 A |
| 4,532,896 | 8/1985 | Nakahara et al. | 123/193 H |
| 4,569,313 | 2/1986 | Nobu | 123/41.74 |
| 4,635,591 | 1/1987 | Hledin | 123/41.32 |
| 4,825,817 | 5/1989 | Romanowski | 123/41.82 R |
| 5,094,193 | 3/1992 | Yoshikawa | 123/41.82 R |

*Primary Examiner*—Noah P. Kamen
*Attorney, Agent, or Firm*—Kelly, Bauersfeld & Lowry

[57] ABSTRACT

A cylinder head for an internal combustion engine includes a replaceable combustion chamber dome and an engine cylinder head housing which receives and supports the combustion chamber dome therein. The dome includes a spark plug housing that fits within an aperture within the engine cylinder head housing in such a way that rotational movement of the dome relative to the housing is prevented. The engine cylinder head housing includes a fluid coolant inlet port, a dome cooling chamber in fluid communication with the inlet port and which surrounds an outer periphery of the dome, and an exhaust port in fluid communication with the dome cooling chamber whereby coolant is directed to a cylinder block for the engine. The housing further includes a cylinder head housing cooling chamber in fluid communication with coolant within the cylinder block, and an outlet port in fluid communication with the cylinder head housing cooling chamber.

23 Claims, 3 Drawing Sheets

CYLINDER HEAD FOR INTERNAL COMBUSTION ENGINES

BACKGROUND OF THE INVENTION

This invention relates generally to internal combustion engines. More specifically, the present invention relates to a cylinder head comprising one or more replaceable combustion chamber domes supported within a fluid-cooled housing.

Two cycle internal combustion (IC) engines are characterized by one or more cylinders consisting essentially of cylindrical bores within an engine or cylinder block. A piston fits within the cylinder such that it can move reciprocally. One end of the cylinder is closed by a cylinder head to establish a combustion chamber between a top of the piston and the cylinder head. The two cycle cylinder construction differs from four cycle cylinder construction in that the latter incorporates intake and exhaust valves in the cylinder head while the two cycle engine has intake and exhaust ports in a wall of the cylinder.

When the piston is reciprocated to its lowest position in the cylinder, the maximum volume of the cylinder is defined. The minimum cylinder volume is defined when the piston is at its highest position in the cylinder. The ratio of maximum volume to minimum volume is referred to as compression ratio. The greater the compression ratio, the more efficient the engine. In most IC engines, the cylinder head is manufactured with a shaped pocket or chamber which defines the cylinder volume at the highest piston position and therefore directly affects the performance of the engine.

While combustion chamber definition is the single most important function of the cylinder head, the head also serves to dissipate heat generated by the combustion process. For this reason, water cooled cylinder heads are generally manufactured in two sections by machine or the like.

There are many applications which require changes in cylinder head design. Such changes may be necessitated not only by a need to vary engine compression ratio but also to adapt an engine for different octane rated fuels or for different fuels. In particular, it is common practice to modify cylinder heads in order to develop high performance engines. In some situations, such as in racing, it is often desirable to be able to modify a cylinder head to obtain a performance characteristic suitable for immediate conditions.

Aftermarket cylinder heads are typically manufactured with either integrated domes as part of the cylinder head itself, or with replaceable domes. In the case of cylinder heads utilizing replaceable domes, several problems presently exist. In particular, such domes do not typically provide adequate cooling to both the cylinder head housing and the replaceable domes, and they often rotate during spark plug installation and/or removal.

By way of illustration, if during a touring trip a spark plug requires replacement and during that operation it is discovered that the replaceable dome turns without the plug being removed, the vehicle is unable to be operated further. It must be towed to a location where the cylinder head may be removed. The problem is exacerbated during races where the plugs must be removed and replaced several times. If such dome rotation occurs, the head must be removed, which could limit a racer's ability to arrive at the starting line on time.

With regard to the problem of adequately cooling the cylinder head and, particularly, the replaceable dome, typical cylinder head cooling/flow design does not allow for the distinct flow of coolant therethrough in a plurality of flow paths at different temperatures. Thus, the different cooling requirements of the cylinder head in contrast with that of the replaceable domes are not specifically addressed.

Accordingly, there has been a need for an improved cylinder head for an internal combustion engine wherein the replaceable dome is incapable of rotating relative to an engine cylinder head housing. Additionally, there exists a need for a novel cylinder head design including a plurality of isolated fluid coolant flow paths which enable the coolant which has been heated by the cylinder block to cool the engine cylinder head housing, but also permits the flow of fluid coolant about a combustion chamber dome prior to be directed to the cylinder block. The present invention fulfills these needs and provides other related advantages.

SUMMARY OF THE INVENTION

The present invention resides in an improved cylinder head for internal combustion engines which includes a replaceable combustion chamber dome and an engine cylinder head housing having means for receiving and supporting the replaceable dome therein. The replaceable dome includes a spark plug housing and a dome-forming portion. The engine cylinder head housing includes an aperture for receiving the spark plug housing therein in a manner preventing rotational movement of the replaceable dome relative to the engine cylinder head housing.

In a preferred form of the invention, means are associated with the replaceable dome and the dome receiving and supporting means, for preventing rotational movement of the replaceable dome relative to the engine cylinder head housing. The rotational movement preventing means comprises a planar inner surface which defines a portion of the spark plug housing receiving aperture, and a corresponding planar outer surface which defines a portion of the spark plug housing and is situated adjacent to the planar inner surface. More specifically, the planar inner surface comprises a plurality of distinct planar segments. The planar outer surface comprises a plurality of distinct planar segments which correspond to the distinct planar segments of the inner surface.

The illustrated cylinder head is for a two cylinder engine. Means are provided for directing a fluid coolant into the cylinder head to cool both of the replaceable combustion chamber domes and then exhausting the fluid coolant to the cylinder block. Means are also provided within the cylinder head for directing the fluid coolant from the cylinder block into the cylinder head to cool the cylinder head housing.

More specifically, the engine cylinder head housing includes a fluid coolant inlet port and a first dome cooling chamber in fluid communication with the inlet port and which surrounds an outer periphery of the dome-forming portion of the first replaceable dome. A second dome cooling chamber is provided in fluid communication with the first dome cooling chamber, which surrounds an outer periphery of the dome-forming portion of the second replaceable dome. An exhaust port is provided in fluid communication with the second dome cooling chamber whereby coolant is directed to the cylinder block for the internal combustion engine. Coolant from the cylinder block then flows to a pair of cylinder head housing cooling chambers. A pair of outlet ports are provided in fluid communication with the cylinder head housing cooling chambers to return the fluid coolant to its source, or in the case of a personal watercraft, to expel the fluid coolant overboard.

Each of the replaceable combustion chamber domes includes a cooling fin which extends outwardly from the dome-forming portion into its respective dome cooling chamber. Each dome cooling chamber includes a first cavity which surrounds the outer periphery of the dome forming portion of the respective replaceable dome, and a second cavity adjacent to the first cavity and which surrounds the outer periphery of the dome-forming portion of the replaceable dome. The cooling fin extends between the first and second cavities. The first cavity includes means for inducing turbulent flow of the coolant within the dome cooling chamber. The turbulent flow inducing means includes a plurality of recesses within an outer wall of the dome cooling chamber.

In the preferred form of the invention, each replaceable combustion chamber dome includes a central threaded aperture for receiving a spark plug therein. The inner surface of the spark plug housing receiving aperture and the outer surface of the spark plug housing are each provided four planar surfaces at right angles which permit the replaceable dome to be supporting within the engine cylinder head housing while preventing relative rotational movement therebetween.

In an alternative form of the invention, the replaceable domes are provided with a pair of threaded apertures for receiving two spark plugs therein. Rotational movement of the replaceable domes relative to the engine cylinder head housing is prevented by simply providing two corresponding planar surfaces on both the spark plug housing and the spark plug housing receiving aperture.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
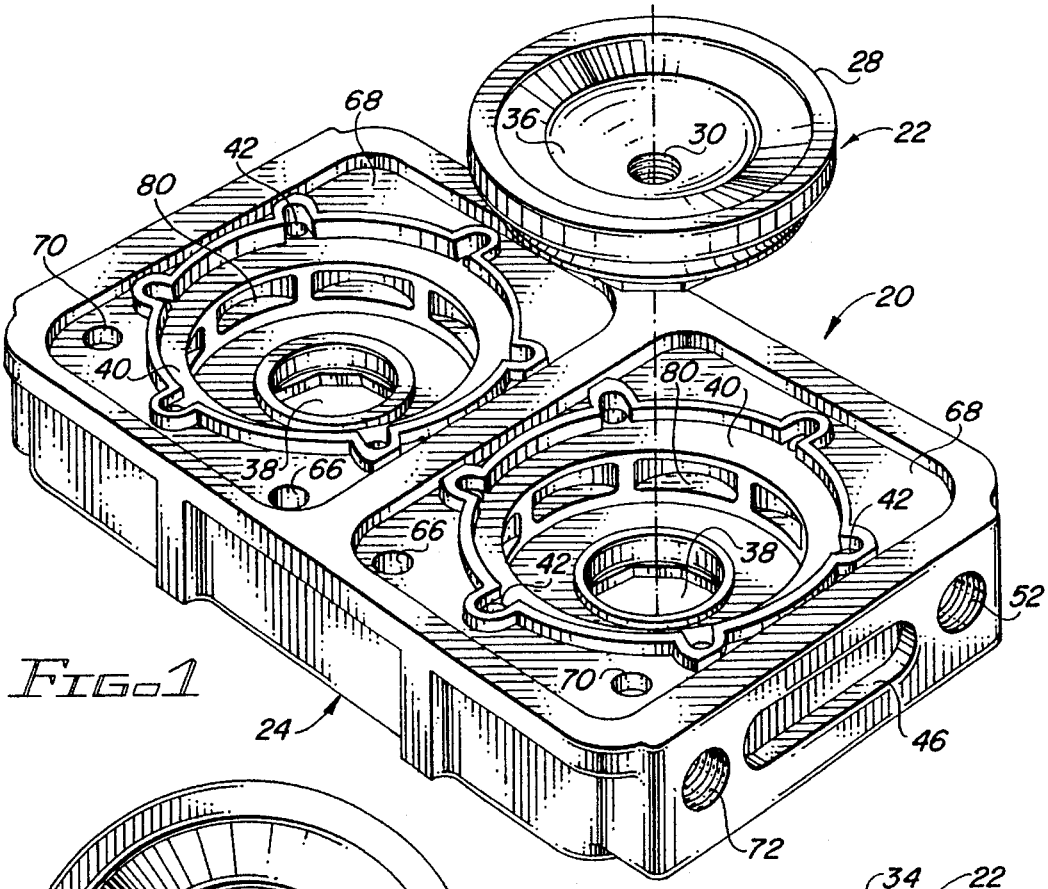
FIG. 1 is a bottom perspective view of one preferred form of an improved cylinder head for an internal combustion engine embodying the invention, having a replaceable combustion chamber dome shown in exploded relation with a cylinder head housing.

As shown in the drawings for purposes of illustration, the present invention is concerned with an improved cylinder head for an internal combustion engine, generally designated in the accompanying drawings by the reference number 20. The illustrated improved cylinder head 20 is intended for use on a two-cylinder, two-stroke internal combustion engine (not shown), and generally comprises a pair of replaceable combustion chamber domes 22 that are received by and supporting within an engine cylinder head housing 24.

Figure 2:
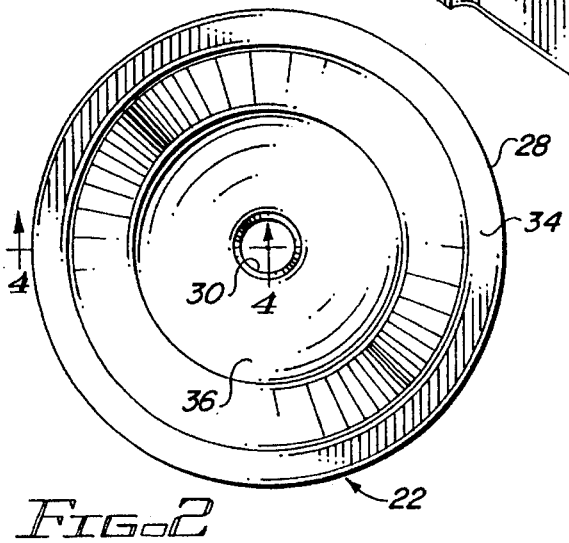
FIG. 2 is a bottom plan view of the replaceable combustion chamber dome shown in FIG. 1.
Figure 3:
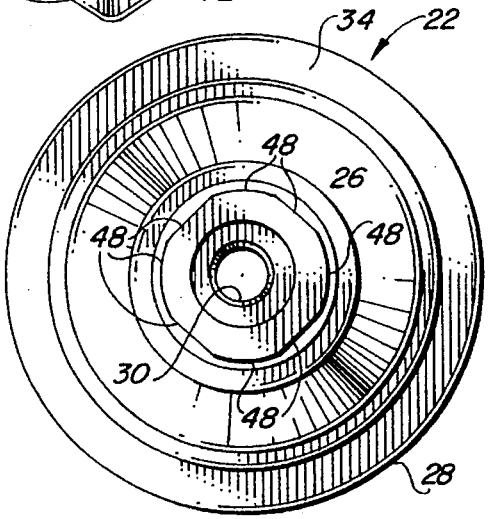
FIG. 3 is a top plan view of the combustion chamber dome shown in FIGS. 1 and 2.
Figure 4:
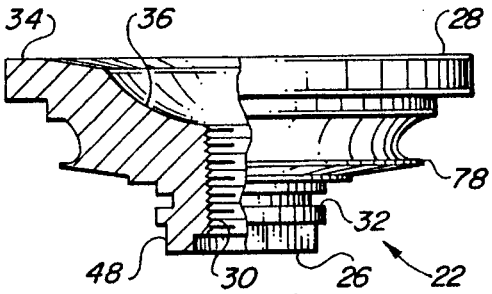
FIG. 4 is an elevational and partially sectional view of the combustion chamber dome taken generally along the line 4—4 of FIG. 2.
Figure 7:
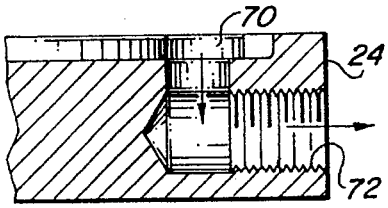
FIG. 7 is an enlarged fragmented section taken generally along the line 7—7 of FIG. 5.
Figure 5:
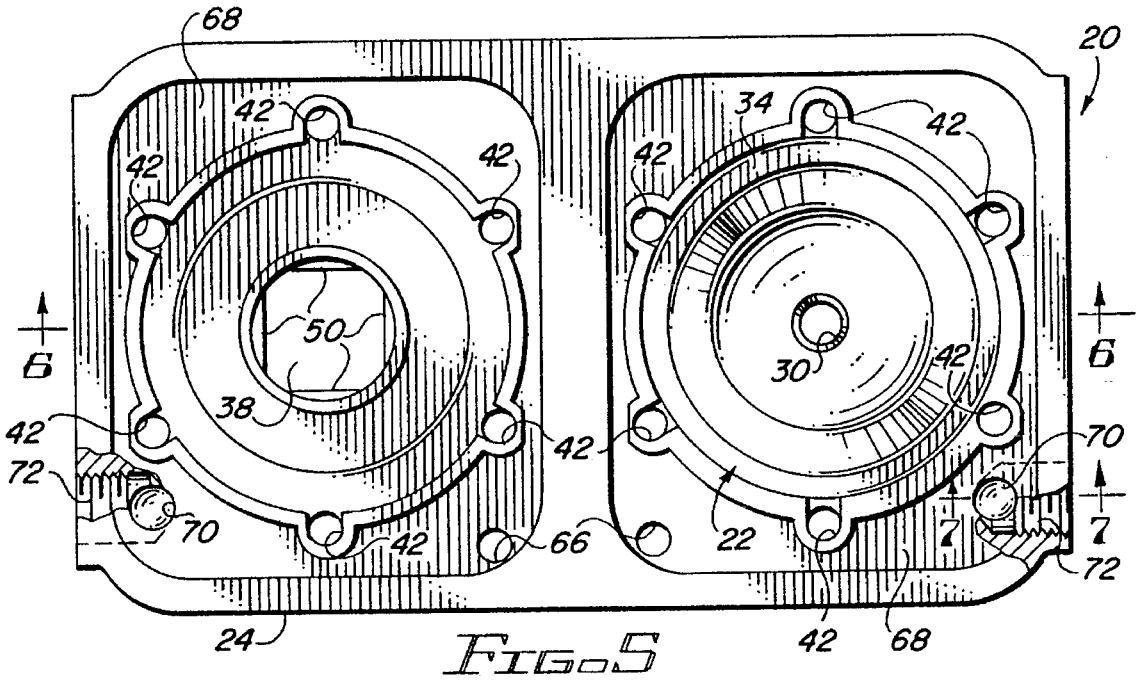
FIG. 5 is a partially sectional top plan view of the cylinder head shown in FIG. 1, wherein only one combustion chamber dome is shown in place within the cylinder head housing.
Figure 6:
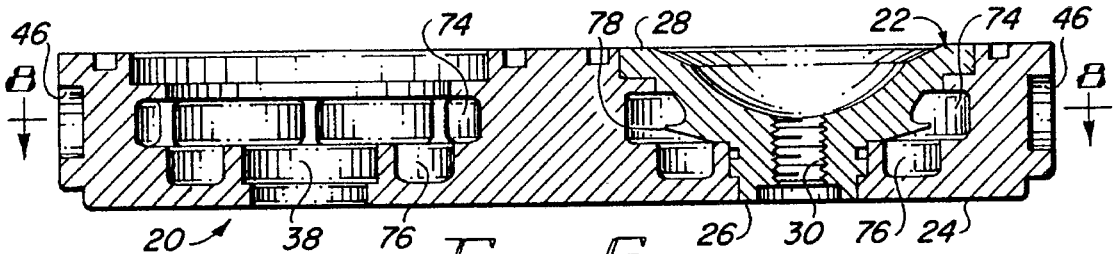
FIG. 6 is a sectional view taken generally along the line 6—6 of FIG. 5.
Figure 8:
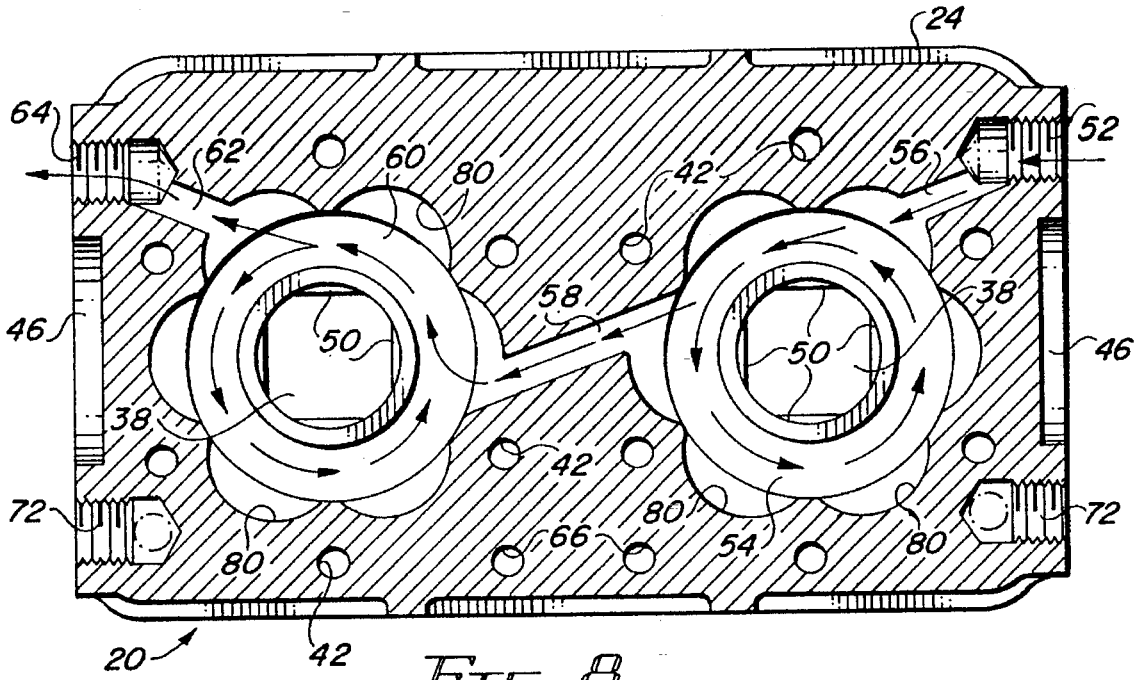
FIG. 8 is a sectional view taken along the line 8—8 of FIG. 6, illustrating a flow path through the cylinder head for directing a fluid coolant into the cylinder head to cool the replaceable domes.

In one preferred form of the invention, illustrated in FIGS. 1–8, each of the replaceable combustion chamber domes includes a spark plug housing 26 and an integral dome-forming portion 28. The spark plug housing 26 includes a central threaded aperture 30 for securing a spark plug, and an exterior circular groove 32 into which an O-ring (not shown) may be placed for providing a fluid seal between an exterior surface of the spark plug housing 26 and an adjacent surface of the engine cylinder head housing 24. The dome-forming portion 28 includes a circular flange 34 which defines a planar surface surrounding a concave semi-spherical surface 36 which, as is well known in the art, defines the upper portion of a combustion chamber for a respective engine cylinder.

The engine cylinder head housing 24 is configured to receive and support a pair of the replaceable combustion chamber domes 22 therein. In this regard, the housing 24 includes a pair of apertures 38 for receiving the spark plug housings 26 of the domes 22. The inner surface of each spark plug housing receiving aperture 38 corresponds to an external surface of each spark plug housing 26. A circular shoulder 40 is provided below each aperture 38 for supporting the circular flanges 34 of the domes 22. Dimensional control of the depths of the shoulder 40 and the flange 34 thickness ensures that combustion chamber size is maintained. Six apertures 42 extend transversely through the engine cylinder head housing 24 in surrounding relation to each combustion chamber dome 22 when assembled to the cylinder head housing 24. The apertures permit bolts to be passed from a top surface 44 of the cylinder head 20 therethrough for securing it to the engine cylinder block. Elongated recesses 46 at each end of the cylinder head housing 24 facilitate handling of the cylinder head 20.

In accordance with the present invention, means are associated with each respective spark plug housing 26 and spark plug housing receiving aperture 38, for preventing rotational movement of the replaceable domes 22 relative to the cylinder head housing 24. To accomplish this, each spark plug housing 26 is manufactured so that the outer surface thereof comprises a plurality of distinct planar segments 48. Specifically, the outer periphery surface of each spark plug housing 26 comprises eight planar surfaces, four of which are designed to correspond to four inner planar segments 50 provided in each spark plug receiving aperture 28 of the cylinder head housing 24. Thus, the close interfitting relationship of the outer planar segments 48 of the spark plug housings 26 and the inner planar segments 50 of the receiving apertures 38 ensures that the replaceable domes 22 cannot rotate within the engine cylinder head housing 24, especially when a spark plug is being threaded into or being removed from the respective threaded aperture 30. Of course, the rotational movement preventing means may take the form of other corresponding inner and outer planar segments on, respectively, the cylinder head housing 24 and the replaceable domes 22, provided there is a close interfitting relationship therebetween which ensures that the replaceable domes 22 cannot rotate within the engine cylinder head housing 24.

The engine cylinder head housing 24 provides two distinct fluid-coolant flow paths therethrough, each being isolated from the other, to provide separate cooling of the replaceable domes 22 and the cylinder head housing 24 generally. In this regard, a threaded aperture 52 in a side wall of the cylinder head housing 24 provides an inlet port for the fluid coolant. The inlet port 52 is placed in fluid communication with a first dome cooling chamber 52 via a first connecting passageway 56. The first dome cooling chamber 54 is configured to surround an outer periphery of the dome-forming portion 28 of the first replaceable dome 22. A second coolant connecting passageway 58 places the first dome cooling chamber 54 in fluid communication with a second dome cooling chamber 60 which surrounds an outer periphery of the dome-forming portion 28 of the second replaceable dome 22. A third connecting passageway 62 places the second dome cooling chamber 60 in fluid communication with a threaded aperture 64 through another side wall of the cylinder head housing 24, which aperture serves as an exhaust port whereby fluid coolant is directed, preferably, to the engine exhaust system and then to the cylinder block for the internal combustion engine. The above described coolant fluid flow path through the engine cylinder head housing 24 provides means for directing the fluid coolant into the cylinder head 20 to cool the replaceable domes 22.

After the fluid coolant has been heated through contact with the engine exhaust system and cylinder block, it is directed back into cylinder head housing cooling chambers 68 formed between the housing 24 and the adjacent cylinder block. Each cooling chamber 68 is in fluid communication with an outlet flow channel 70 which directs the heated fluid coolant from the respective cooling chamber 68 to a respective threaded aperture through a side wall of the cylinder head housing 24 forming an outlet port 72. This fluid flow path through the cylinder head 20 provides fluid coolant at a higher temperature than that utilized to cool the replaceable domes 22, for cooling the cylinder head housing 24 generally. Two ports 66 are provided for temperature sensors or may be used as alternative restrictive outlet ports for racing applications.

Each dome cooling chamber 54 and 60 includes a first cavity 74 which surrounds the outer periphery of the dome-forming portion 28 of the dome, and a second cavity 76 which is adjacent to the first cavity 74 and which also surrounds the outer periphery of the dome-forming portion of the replaceable dome 22. Each of the replaceable domes 22 includes a cooling fin 78 which extends outwardly from the dome-forming portion 28 into the respective dome cooling chamber 54 or 60. The cooling fin 78 extends between the first cavity 74 and the second cavity 76.

Each first cavity 74 further includes means for inducing turbulent flow of the fluid coolant within the respective dome cooling chamber 54 or 60. In particular, the turbulent flow inducing means comprises a plurality of recesses 80 within an outer wall of the dome cooling chambers 54, 60.

In operation, and with specific reference to use of an internal combustion engine for a personal watercraft, water from a pump is received into the cylinder head 20 through the inlet port 52. It passes through the first connecting passageway 56 to the first dome cooling chamber 54 and from thence through the second connecting passageway 58 to the second dome cooling chamber 60. The fluid coolant then passes through the third connecting passageway 62 to the exhaust port 64 where it may be directed as desired, but preferably to the exhaust system and then to the cylinder block. The heated fluid coolant from the cylinder block then flows into the cooling chambers 68. The fluid coolant flows from the cooling chambers 68 through the outlet flow channels 70 to the outlet ports 72 to overboard.

Figure 9:
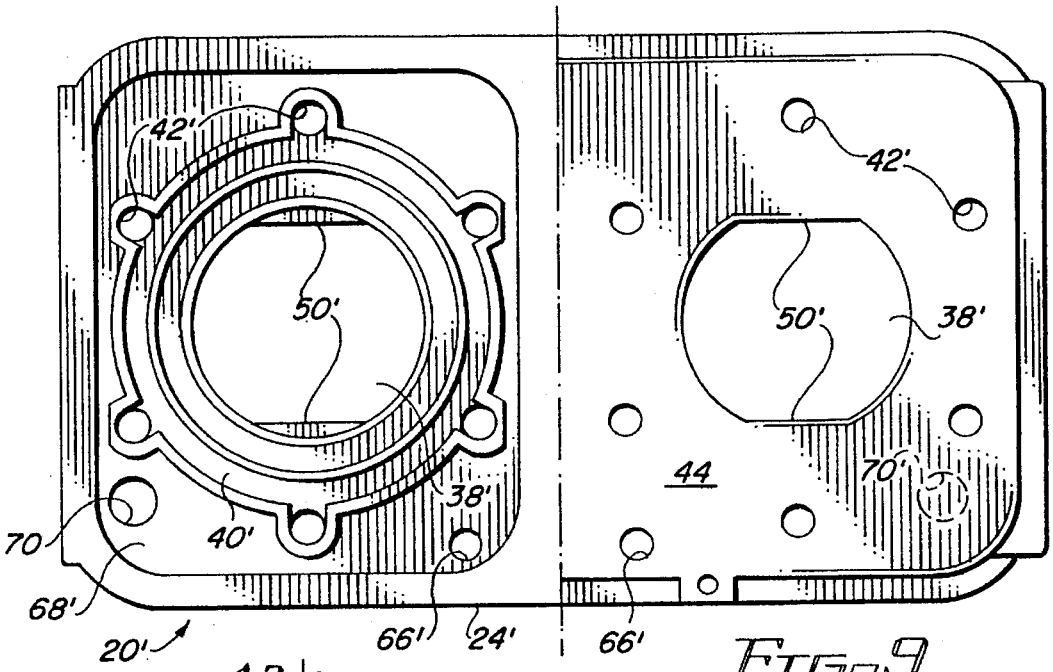
FIG. 9 is a top and bottom plan view of an alternative embodiment of the invention.
Figure 10:
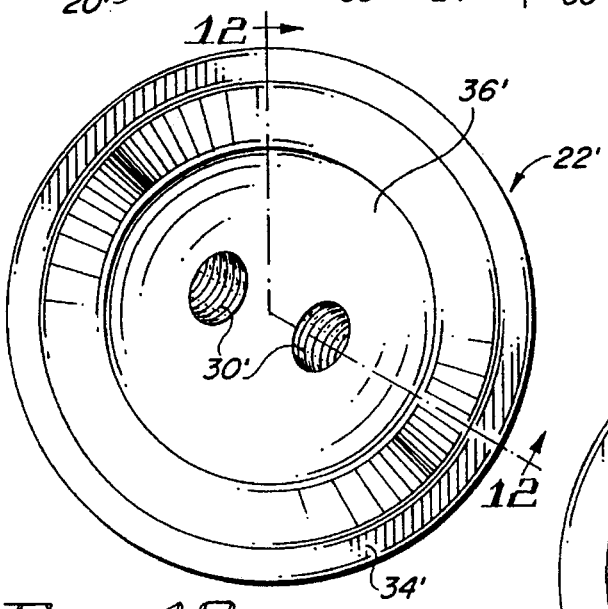
FIG. 10 is a bottom plan view similar to FIG. 2, of an alternative combustion chamber dome including threaded apertures for two spark plugs.
Figure 11:
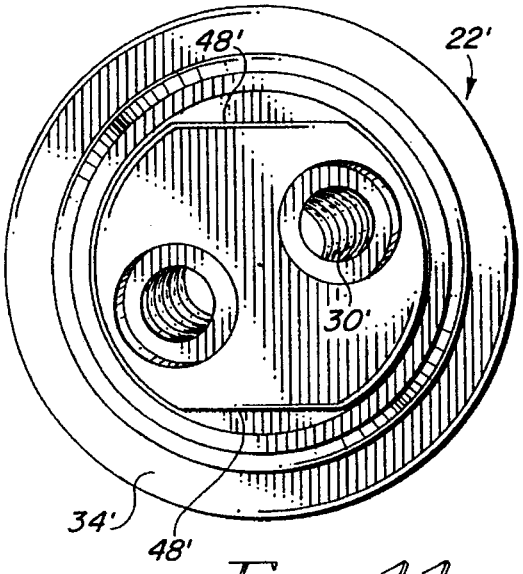
FIG. 11 is a top plan view of the replaceable dome of FIG. 10.
Figure 12:
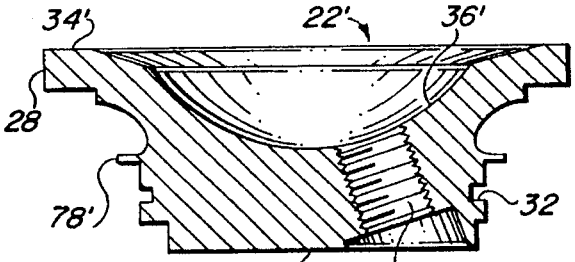
FIG. 12 is a sectional view taken generally along the line 12—12 of FIG. 10.

In an alternate embodiment of the invention, illustrated in FIGS. 9–12, the fluid coolant flow paths through cylinder head housing 24' are the same. The only differences lie in the particular construction of the replaceable domes 22' and the configuration of the inner planar segments 50' within the spark plug housing receiving apertures 38' of the cylinder head housing 24'. In this regard, it will be noted that two threaded apertures 30' are provided through the replaceable domes 22' for accepting two spark plugs. Further, the outer peripheral surface of the spark plug housing 26' as well as the inner surface of the spark plug housing receiving aperture 38' include only a pair of parallel planar segments 48' and 50' which correspond so that when the replaceable domes 22' are properly seated within the cylinder head housing 24', rotational movement of the domes is prevented relative to the housing.

From the foregoing it will be appreciated that the improved cylinder head for internal combustion engines provides replaceable combustion chamber domes 22 which are received and supported within the engine cylinder head housing 24 in such a manner that they will not rotate when, particularly, a spark plug is being threaded into or being removed from either replaceable dome 22. Moreover, two isolated fluid coolant flow paths are provided through the cylinder head 20 to provide cooling to selected components of the cylinder head at varying temperatures.

Although two particular embodiments of the invention have been described in detail for purposes of illustration, various modifications of each may be made without departing from the spirit and scope of the invention. Accordingly, the invention is not to be limited, except as by the appended claims.

We claim:

1. A cylinder head for an internal combustion engine, comprising:

a replaceable combustion chamber dome including a spark plug housing and a dome-forming portion;

an engine cylinder head housing having means for receiving and supporting the replaceable dome therein, the dome receiving and supporting means including an aperture for receiving the spark plug housing; and means for preventing rotational movement of the replaceable dome relative to the engine cylinder head housing, the rotational movement preventing means comprising a planar inner surface defining a portion of the dome receiving and supporting means, and a corresponding planar outer surface defining a portion of the combustion chamber dome and situated adjacent to the planar inner surface.

2. The cylinder head of claim 1, wherein the rotational movement preventing means comprises a planar inner surface which defines a portion of the spark plug housing receiving aperture, and a corresponding planar outer surface which defines a portion of the spark plug housing and is situated adjacent to the planar inner surface.

3. The cylinder head of claim 1, wherein the planar inner surface comprises a plurality of distinct planar segments, and wherein the planar outer surface comprises a plurality of distinct planar segments which correspond to the distinct planar segments of the inner surface.

4. The cylinder head of claim 1, wherein the engine cylinder head housing includes a fluid coolant inlet port, a dome cooling chamber in fluid communication with the inlet port and which surrounds an outer periphery of the dome-forming portion of the replaceable dome, an exhaust port in fluid communication with the dome cooling chamber whereby coolant is directed to a cylinder block for the internal combustion engine, a cylinder head housing cooling chamber in fluid communication with coolant within the cylinder block, and an outlet port in fluid communication with the cylinder head housing cooling chamber.

5. The cylinder head of claim 4, wherein the replaceable dome includes a cooling fin which extends outwardly from the dome-forming portion into the dome cooling chamber.

6. The cylinder head of claim 5, wherein the dome cooling chamber includes a first cavity which surrounds the outer periphery of the dome-forming portion of the replaceable dome, and a second cavity adjacent to the first cavity and which surrounds the outer periphery of the dome-forming portion of the replaceable dome, and wherein the cooling fin extends between the first and second cavities.

7. The cylinder head of claim 6, wherein the first cavity includes means for inducing turbulent flow of the coolant within the dome cooling chamber.

8. The cylinder head of claim 7, wherein the turbulent flow inducing means includes a plurality of recesses within an outer wall of the dome cooling chamber.

9. The cylinder head of claim 1, wherein the engine cylinder head housing includes a fluid coolant inlet port, a first dome cooling chamber in fluid communication with the inlet port and which surrounds an outer periphery of the dome-forming portion of a first replaceable dome, a second dome cooling chamber in fluid communication with the first dome cooling chamber and which surrounds an outer periphery of the dome-forming portion of the second replaceable dome, an exhaust port in fluid communication with the second dome cooling chamber whereby coolant is directed to a cylinder block for the internal combustion engine, a cylinder head housing cooling chamber in fluid communication with coolant within the cylinder block, and an outlet port in fluid communication with the cylinder head housing cooling chamber.

10. A cylinder head for an internal combustion engine, comprising:

a replaceable combustion chamber dome including a spark plug housing and a dome-forming portion;

an engine cylinder head housing having means for receiving and supporting the replaceable dome therein, the replaceable dome receiving and supporting means including an aperture for receiving the spark plug housing;

means associated with the replaceable dome and the dome receiving and supporting means, for preventing rotational movement of the replaceable dome relative to the engine cylinder head housing, the rotational movement preventing means comprising a planar inner surface which defines a portion of the dome receiving and supporting means, and a corresponding planar outer surface which defines a portion of the replaceable dome and is situated adjacent to the planar inner surface;

means for directing a fluid coolant into the cylinder head to cool the replaceable dome and then exhausting the fluid coolant to a cylinder block; and means for directing the fluid coolant from the cylinder block through the cylinder head to an outlet.

11. The cylinder head of claim 10, wherein the replaceable dome fluid coolant directing means includes a fluid coolant inlet port, a dome cooling chamber in fluid communication with the inlet port and which surrounds an outer periphery of the dome-forming portion of the replaceable dome, and an exhaust port in fluid communication with the dome cooling chamber whereby coolant is directed to a cylinder block for the internal combustion engine.

12. The cylinder head of claim 11, wherein the replaceable dome includes a cooling fin which extends outwardly from the dome-forming portion into the dome cooling chamber.

13. The cylinder head of claim 12, wherein the dome cooling chamber includes a first cavity which surrounds the outer periphery of the dome-forming portion of the replaceable dome, and a second cavity adjacent to the first cavity and which surrounds the outer periphery of the dome-forming portion of the replaceable dome, and wherein the cooling fin extends between the first and second cavities.

14. The cylinder head of claim 13, wherein the first cavity includes means for inducing turbulent flow of the coolant within the dome cooling chamber, the turbulent flow inducing means including a plurality of recesses within an outer wall of the dome cooling chamber.

15. The cylinder head of claim 10, wherein the cylinder head housing fluid coolant directing means includes a cylinder head housing cooling chamber and an outlet port in fluid communication with the cylinder head housing cooling chamber.

16. The cylinder head of claim 10, wherein the engine cylinder head housing includes a fluid coolant inlet port, a first dome cooling chamber in fluid communication with the inlet port and which surrounds an outer periphery of the dome-forming portion of a first replaceable dome, a second dome cooling chamber in fluid communication with the first dome cooling chamber and which surrounds an outer periphery of the dome-forming portion of the second replaceable dome, an exhaust port in fluid communication with the second dome cooling chamber whereby coolant is directed to a cylinder block for the internal combustion engine, a cylinder head housing cooling chamber in fluid communication with coolant within the cylinder block, and an outlet port in fluid communication with the cylinder head housing cooling chamber.

17. A cylinder head for an internal combustion engine, comprising:

a replaceable combustion chamber dome including a spark plug housing and a dome-forming portion;

an engine cylinder head housing having means for receiving and supporting the replaceable dome therein, the dome receiving and supporting means including an aperture for receiving the spark plug housing;

means associated with the spark plug housing and the spark plug housing receiving aperture, for preventing rotational movement of the replaceable dome relative to the engine cylinder head housing, wherein the rotational movement preventing means comprises a planar inner surface which defines a portion of the spark plug housing receiving aperture, and a corresponding planar outer surface which defines a portion of the spark plug housing and is situated adjacent to the planar inner surface;

means for directing a fluid coolant into the cylinder head to cool the replaceable dome and then exhausting the fluid coolant to a cylinder block; and means for directing the fluid coolant from the cylinder block through the cylinder head to an outlet.

18. The cylinder head of claim 17, wherein the engine cylinder head housing includes a fluid coolant inlet port, a dome cooling chamber in fluid communication with the inlet port and which surrounds an outer periphery of the dome-forming portion of the replaceable dome, an exhaust port in fluid communication with the dome cooling chamber whereby coolant is directed to the cylinder block for the internal combustion engine, a cylinder head housing cooling chamber in fluid communication with coolant within the cylinder block, and an outlet port in fluid communication with the cylinder head housing cooling chamber.

19. The cylinder head of claim 18, wherein the replaceable dome includes a cooling fin which extends outwardly from the dome-forming portion into the dome cooling chamber, and wherein the dome cooling chamber includes a first cavity which surrounds the outer periphery of the dome-forming portion of the replaceable dome, and a second cavity adjacent to the first cavity and which surrounds the outer periphery of the dome-forming portion of the replaceable dome, and wherein the cooling fin extends between the first and second cavities.

20. A cylinder head for an internal combustion engine, comprising:

a replaceable combustion chamber dome including a spark plug housing and a dome-forming portion;

an engine cylinder head housing having means for receiving and supporting the replaceable dome therein, the dome receiving and supporting means including an aperture for receiving the spark plug housing; and means associated with the replaceable dome and the dome housing receiving and supporting means, for preventing rotational movement of the replaceable dome relative to the engine cylinder head housing;

wherein the engine cylinder head housing includes a fluid coolant inlet port, a dome cooling chamber in fluid communication with the inlet port and which surrounds an outer periphery of the dome-forming portion of the replaceable dome, an exhaust port in fluid communication with the dome cooling chamber whereby coolant is directed to a cylinder block for the internal combustion engine, a cylinder head housing cooling chamber in fluid communication with coolant within the cylinder block, and an outlet port in fluid communication with the cylinder head housing cooling chamber;

wherein the replaceable dome includes a cooling fin which extends outwardly from the dome-forming portion into the dome cooling chamber;

wherein the dome cooling chamber includes a first cavity which surrounds the outer periphery of the dome-forming portion of the replaceable dome, and a second cavity adjacent to the first cavity and which surrounds the outer periphery of the dome-forming portion of the replaceable dome, and wherein the cooling fin extends between the first and second cavities; and wherein the first cavity includes means for inducing turbulent flow of the coolant within the dome cooling chamber, comprising a plurality of recesses within an outer wall of the dome cooling chamber.

21. A cylinder head for an internal combustion engine, comprising:

a replaceable combustion chamber dome including a spark plug housing and a dome-forming portion;

an engine cylinder head housing having means for receiving and supporting the replaceable dome therein, the dome receiving and supporting means including an aperture for receiving the spark plug housing; and means associated with the replaceable dome and the dome housing receiving and supporting means, for preventing rotational movement of the replaceable dome relative to the engine cylinder head housing;

wherein the engine cylinder head housing includes a fluid coolant inlet port, a first dome cooling chamber in fluid communication with the inlet port and which surrounds an outer periphery of the dome-forming portion of a first replaceable dome, a second dome cooling chamber in fluid communication with the first dome cooling chamber and which surrounds an outer periphery of the dome-forming portion of the second replaceable dome, an exhaust port in fluid communication with the second dome cooling chamber whereby coolant is directed to a cylinder block for the internal combustion engine, a cylinder head housing cooling chamber in fluid communication with coolant within the cylinder block, and an outlet port in fluid communication with the cylinder head housing cooling chamber.

22. A cylinder head for an internal combustion engine, comprising:

a replaceable combustion chamber dome including a spark plug housing and a dome-forming portion;

an engine cylinder head housing having means for receiving and supporting the replaceable dome therein, the replaceable dome receiving and supporting means including an aperture for receiving the spark plug housing;

means for directing a fluid coolant into the cylinder head to cool the replaceable dome and then exhausting the fluid coolant to a cylinder block; and means for directing the fluid coolant from the cylinder block through the cylinder head to an outlet;

wherein the replaceable dome fluid coolant directing means includes a fluid coolant inlet port, a dome cooling chamber in fluid communication with the inlet port and which surrounds an outer periphery of the dome-forming portion of the replaceable dome, and an exhaust port in fluid communication with the dome cooling chamber whereby coolant is directed to a cylinder block for the internal combustion engine;

wherein the replaceable dome includes a cooling fin which extends outwardly from the dome-forming portion into the dome cooling chamber;

wherein the dome cooling chamber includes a first cavity which surrounds the outer periphery of the dome-forming portion of the replaceable dome, and a second cavity adjacent to the first cavity and which surrounds the outer periphery of the dome-forming portion of the replaceable dome, and wherein the cooling fin extends between the first and second cavities; and wherein the first cavity includes means for inducing turbulent flow of the coolant within the dome cooling chamber, the turbulent flow inducing means including a plurality of recesses within an outer wall of the dome cooling chamber.

23. A cylinder head for an internal combustion engine, comprising:

a replaceable combustion chamber dome including a spark plug housing and a dome-forming portion;

an engine cylinder head housing having means for receiving and supporting the replaceable dome therein, the dome receiving and supporting means including an aperture for receiving the spark plug housing;

means associated with the spark plug housing and the spark plug housing receiving aperture, for preventing rotational movement of the replaceable dome relative to the engine cylinder head housing;

means for directing a fluid coolant into the cylinder head to cool the replaceable dome and then exhausting the fluid coolant to a cylinder block; and means for directing the fluid coolant from the cylinder block through the cylinder head to an outlet;

wherein the engine cylinder head housing includes a fluid coolant inlet port, a dome cooling chamber in fluid communication with the inlet port and which surrounds an outer periphery of the dome-forming portion of the replaceable dome, an exhaust port in fluid communication with the dome cooling chamber whereby coolant is directed to the cylinder block for the internal combustion engine, a cylinder head housing cooling chamber in fluid communication with coolant within the cylinder block, and an outlet port in fluid communication with the cylinder head housing cooling chamber; and wherein the replaceable dome includes a cooling fin which extends outwardly from the dome-forming portion into the dome cooling chamber, and wherein the dome cooling chamber includes a first cavity which surrounds the outer periphery of the dome-forming portion of the replaceable dome, and a second cavity adjacent to the first cavity and which surrounds the outer periphery of the dome-forming portion of the replaceable dome, and wherein the cooling fin extends between the first and second cavities.

* * * * *